United States Patent [19]

Svajgl

[11] Patent Number: 4,564,182

[45] Date of Patent: Jan. 14, 1986

[54] TEMPORARY SUPPORT FOR GUTTERS

[76] Inventor: Donald E. Svajgl, 4205 Polk St., Omaha, Nebr. 68107

[21] Appl. No.: 700,047

[22] Filed: Feb. 11, 1985

Related U.S. Application Data

[63] Continuation-in-part of Ser. No. 491,595, May 4, 1983, abandoned.

[51] Int. Cl.[4] ..... B23Q 3/02

[52] U.S. Cl. ..... 269/102; 269/274; 269/275; 269/289 MR; 269/904

[58] Field of Search ..... 269/904, 289 MR, 102, 269/274, 275; 254/401–406, 389; 52/547, 520; 248/222.4; 33/174 G, 187, 188

[56] References Cited

U.S. PATENT DOCUMENTS

| | | | |
|---|---|---|---|
| 2,048,948 | 7/1936 | Postlewaite | 269/289 MR |
| 3,643,935 | 2/1972 | Bell | 269/904 |
| 4,164,346 | 8/1979 | Sickler | 269/289 MR |
| 4,176,830 | 12/1979 | Isley | 269/289 MR |
| 4,254,945 | 3/1981 | Paulson et al. | 269/904 |

*Primary Examiner*—Robert C. Watson
*Attorney, Agent, or Firm*—Zarley, McKee, Thomte, Voorhees & Sease

[57] ABSTRACT

An apparatus for temporarily supporting a gutter during the installation thereof is described comprising a vertically disposed inner frame member adapted to be movably secured to the fascia board positioned adjacent the edge of the roof. A horizontally extending bottom frame member extends outwardly from the lower end of the inner frame member. An outer frame member extends upwardly and outwardly from the outer end of the bottom frame member. A horizontally disposed support extends between the inner and outer frame members above the bottom frame member adapted to support the bottom of the gutter. A plurality of the apparatuses are mounted on the fascia board in a spaced-apart relationship. The gutter is then positioned on the apparatuses and then nailed to the fascia board in conventional fashion. After the gutter has been nailed to the fascia board, the apparatuses are removed.

3 Claims, 7 Drawing Figures

TEMPORARY SUPPORT FOR GUTTERS

CROSS REFERENCE TO RELATED APPLICATION

This is a continuation-in-part patent application of copending patent application Ser. No. 491,595 filed on May 4, 1983 now abandoned.

BACKGROUND OF THE INVENTION

This invention relates to a support for gutters and more particularly to a temporary support for gutters during the installation thereof.

Gutters or eaves troughs are normally secured to the fascia board which extends downwardly from the lower edge of the roof. The gutters are normally secured to the fascia board by means of long nails or spikes which are extended through the upper ends of the inner and outer gutter portions. The nails or spikes are hammered into the fascia board and preferably into the end of a rafter therebehind.

A large number of the present-day gutters or eaves troughs are of one-piece construction and the positioning of the gutters adjacent the fascia board during the installation thereof is quite difficult and often requires two or three persons to hold the gutter in position while the spikes are being driven into the fascia board. This task is further complicated by the fact that the gutter is preferably sloped towards the downspout so that proper drainage from the gutter will occur.

The temporary support of the pending application represented a significant advance in the art. However, it has been found that the support is sometimes difficult to remove from its supporting nails since the support must be moved upwardly relative to the nails and the gutter during the disconnection process but the support is restricted in its upward movement due to the engagement of the roller with the underside of the gutter.

Therefore, it is a principal object of the invention to provide an improved device for temporarily supporting gutters during the installation thereof.

A further object of the invention is to provide a device which may be used to temporarily support a gutter in a predetermined position.

Still another object of the invention is to provide a device which enables one person to mount a gutter on a fascia board.

Still another object of the invention is to provide a temporary support for gutters which is removable from the fascia board after the gutter has been nailed thereto so that the devices may be subsequently reused.

Still another object of the invention is to provide a temporary support for gutters which will not damage the gutter while it is supporting the gutter.

Yet another object of the invention is to provide a temporary support including a supporting roller which is resiliently mounted to facilitate the removal of the support after the gutter has been installed.

Still another object of the invention is to provide a temporary support for gutters including a compressible or resilient supporting member provided thereon which facilitates the removal of the support after the gutter has been installed.

These and other objects will be apparent to those skilled in the art.

SUMMARY OF THE INVENTION

Figure 1:
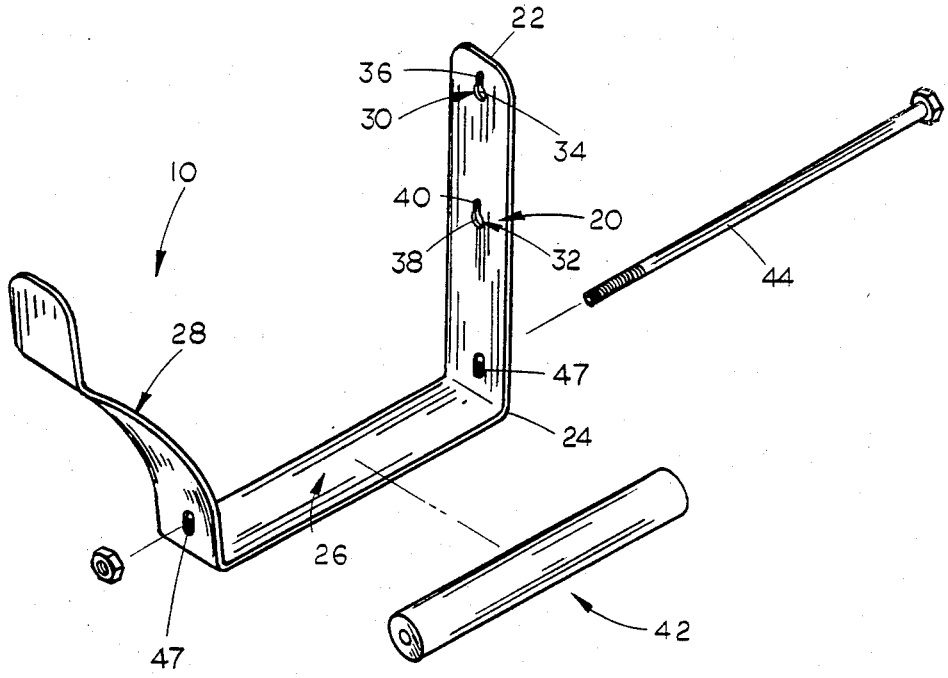
FIG. 1 is an exploded perspective view of the support of this invention.
Figure 2:
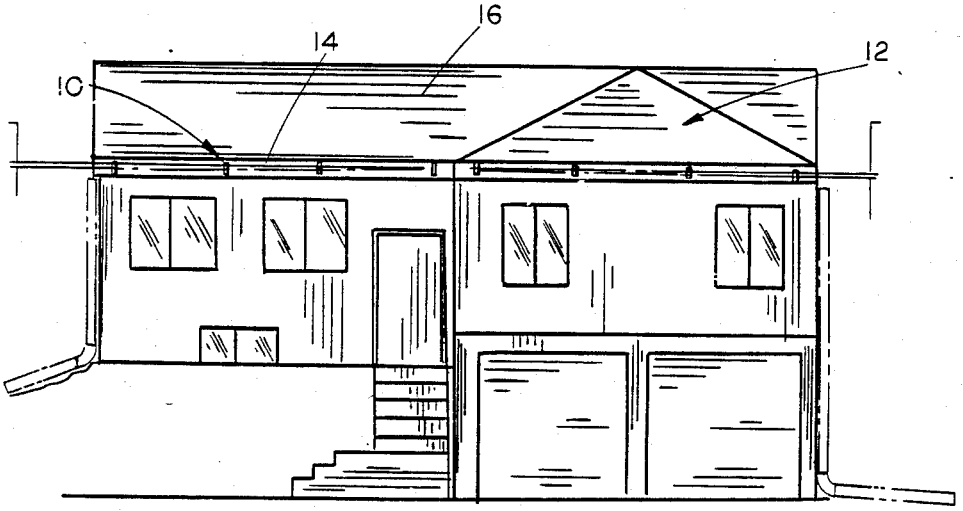
FIG. 2 is an elevational view of a home having the supports of this invention mounted thereon prior to the gutter being installed.
Figure 3:
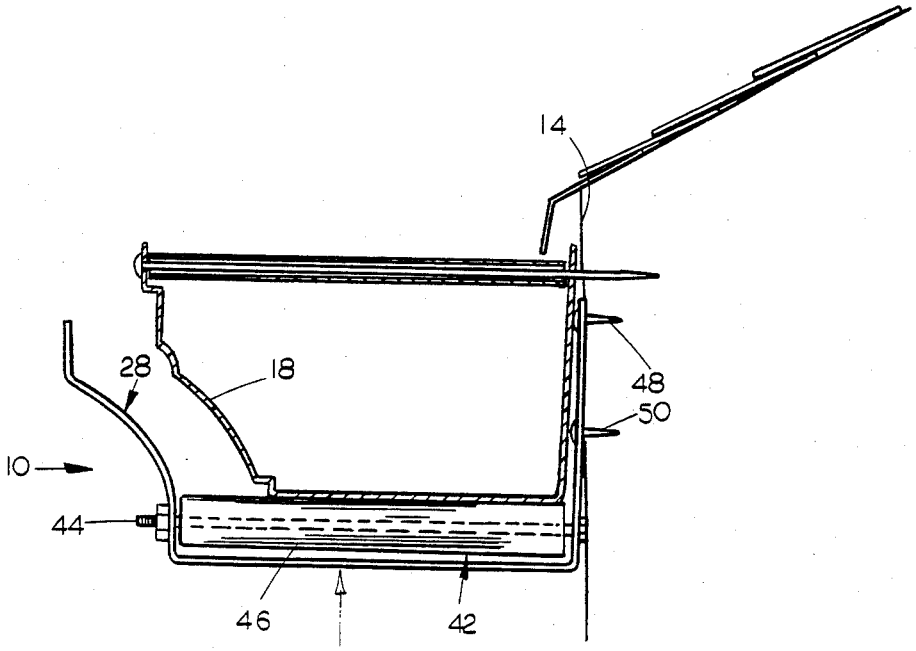
FIG. 3 is an end view illustrating one of the supports secured to the house with the gutter being mounted thereon.
Figure 4:
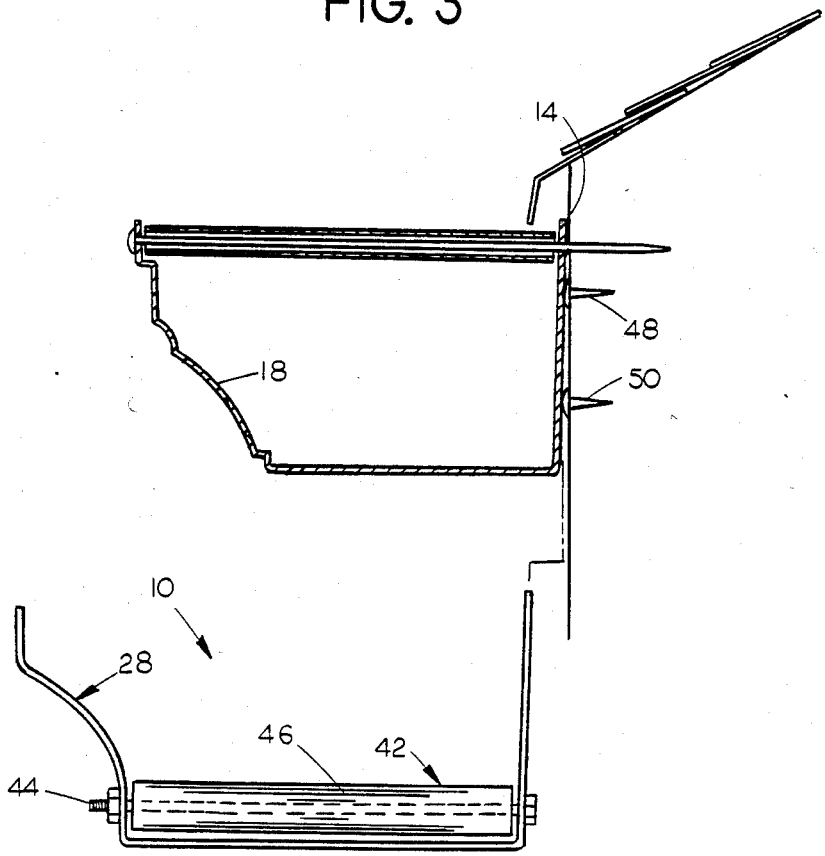
FIG. 4 is a view similar to FIG. 4 except that the support has been removed from the fascia board of the house.
Figure 5:
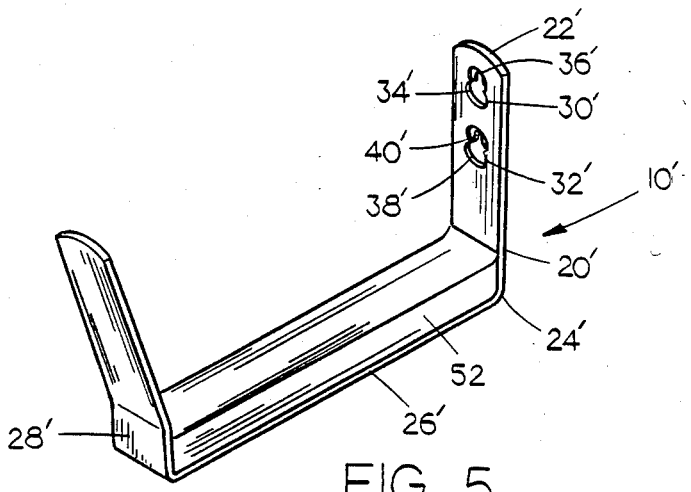
FIG. 5 is a perspective view of a modified form of the support of this invention.
Figure 6:
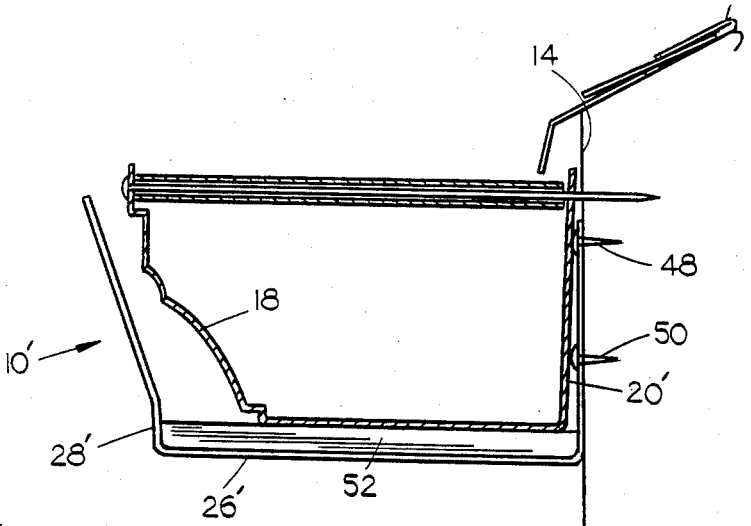
FIG. 6 is an end view illustrating the support of FIG. 5 secured to the house with the gutter being mounted thereon.
Figure 7:
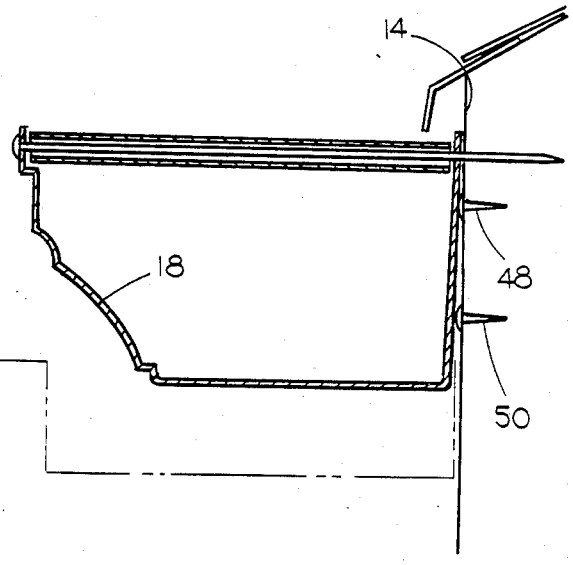
FIG. 7 is a view similar to FIG. 6 except that the support has been removed from the fascia board of the house.
Figure 7:
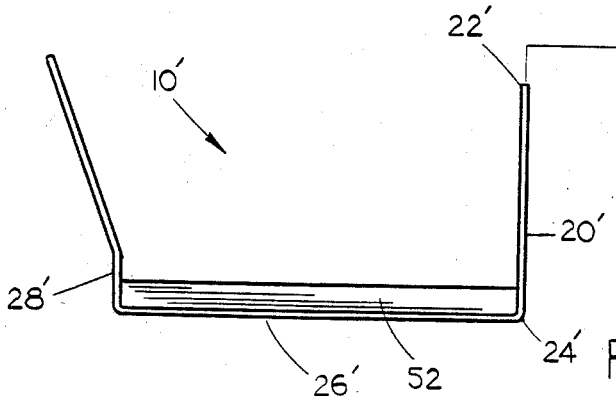

A temporary support for a gutter is described so that the gutter may be temporarily supported adjacent the fascia board during the installation thereof. A plurality of the supports are removably secured to the fascia board in a horizontally spaced condition with the supports being progressively positioned vertically downwardly relative to the adjacent support towards the downspout. After the supports have been temporarily secured to the fascia board, the gutter is positioned on the supports and then nailed to the fascia board. After the gutter has been nailed to the fascia board, the supports are removed from the fascia board.

DESCRIPTION OF THE PREFERRED EMBODIMENT

The support of this invention is referred to generally by the reference numeral 10 while the reference numeral 12 refers to a building having a fascia board 14 positioned adjacent the lower edge of the roof 16. The numeral 18 refers to a gutter of conventional design which will be mounted on a plurality of the supports as will be described in more detail hereinafter.

Support 10 comprises a flat inner frame member 20 having an upper end 22 and a lower end 24. Bottom frame member 26 extends horizontally outwardly from the lower end of inner frame member 20 and terminates in an outer frame member 28 which extends upwardly and outwardly therefrom as seen in the drawings.

Inner frame member 20 is provided with a pair of openings 30 and 32 formed therein. Opening 30 includes an enlarged portion 34 and an elongated slot portion 36 extending upwardly therefrom. Similarly, opening 32 includes an enlarged portion 38 and an elongated slot 40 extending upwardly therefrom.

The numeral 42 refers to a support member which is secured to and extends between frame members 20 and 28 adjacent the lower ends thereof. More particularly, shaft 44 is vertically movably mounted on and extends between the frame members 20 and 28 and has a resilient cylindrical member 46 mounted thereon. Shaft 44 is resiliently vertically mounted on the frame members 20 and 28 by means of the springs 47.

The gutter 18 is installed on the fascia board 14 as follows. Initially, the preferred slope of the gutter 18 would be determined so that drainage will occur from the gutter 18 into the downspout. Once that slope has been determined from one end of the fascia board to the other, a chalk line or the same could be snapped along the exterior surface of the fascia board. A second chalk line would also be snapped beneath the first line with the distance between the upper and lower chalk lines corresponding to the difference between the centers of openings 34 and 38.

Nails 48 and 50 are then partially driven into the fascia board in the two chalk lines at horizontally spaced-apart locations. A support 10 is then positioned on each pair of the nails 48 and 50 by positioning the nail heads in the openings 34 and 38. The support 10 is then moved downwardly so that the shank of the nails are received by the slots 36 and 40 to removably maintain the support 10 on the fascia board 14.

The gutter 18 is then lifted onto the spaced-apart supports 10 and supported on the support member 42. The resilient member 46 prevents scratching or other damage to the bottom of the gutter 18 during the installation. When the gutter is positioned on the supports 10, the gutter is then nailed to the fascia board 14 in conventional fashion. When the gutter 18 has been conventionally attached to the fascia board 14, each of the supports 10 are removed from the fascia board. The removal of a support 10 is accomplished by simply moving the support 10 upwardly relative to the gutter and the nails 48 and 50 until the heads of the nails register with the enlarged portions 34 and 38. The upward movement of the support 10 is permitted inasmuch as the support may be moved upwardly relative to the resilient cylindrical member 42 due to the provision of the springs 47 and the compressibility of the resilient member 42. The support 10 is then moved outwardly from the nails to disengage the inner frame member 20 from the nails.

The numeral 10' refers to a modified form of the support and comprises a flat inner frame member 20' having an upper end 22' and a lower end 24'. Bottom frame member 26' extends horizontally outwardy from the lower end of inner frame member 20' and terminates in an outer frame member 28' which extends upwardly and outwardly therefrom as seen in the drawings.

Inner frame member 20' is provided with a pair of openings 30' and 32' formed therein. Opening 30' includes an enlarged portion 34' and an elongated slot portion 36' extending upwardly therefrom. Similarly, opening 32' includes an enlarged portion 38' and an elongated slot 40' extending upwardly therefrom.

The numeral 52 refers to a compressible or resilient member comprised of sponge rubber or the like which is secured by suitable adhesive to the top surface of bottom frame member 26. Support 10 is utilized in the same manner as support 10 except that the upward movement of the support 10' is permitted during the disconnect stage of the operation due to the fact that the resilient member 52 may be compressed to permit the upward movement of the support 10' relative to the gutter and the nails 48 and 50.

Thus it can be seen that a novel temporary support has been provided to enable gutters to be easily installed by one person. The supports are reusable and greatly facilitate the installation of gutters. Thus it can be seen that the invention accomplishes at least all of its stated objectives.

I claim:

1. An apparatus for temporarily supporting an elongated room gutter during the installation thereof, comprising, a substantially vertically disposed inner frame member adapted to be secured to the fascia board extending downwardly from the edge of the roof of the house upon which the gutter is to be installed, a horizontally extending bottom frame member extending outwardly from the lower end of said vertically disposed frame member, an outer frame member extending upwardly from the outer end of said bottom frame member, said inner frame member including at least one opening closed at the top and including an enlarged portion and an elongated slot portion extending upwardly therefrom whereby, upon suspending said inner frame member on a nail extended through said slot, said opening provides clearance for upward movement of the inner frame member relative to the nail, and vertically yieldable support means positioned between said outer frame member and said inner frame member for supporting the bottom of the gutter thereon while the gutter is being installed, said vertically yieldable support means permitting said inner frame member, bottom frame member and outer frame member to be moved upwardly relative to the fascia board during the removal of the apparatus therefrom after the gutter has been installed.

2. The apparatus of claim 1 wherein said support means comprises a spring mounted roller member.

3. The apparatus of claim 1 wherein said support means comprises a compressible member mounted said bottom frame member.

* * * * *